United States Patent [19]

Reuss

[11] Patent Number: 4,758,185

[45] Date of Patent: Jul. 19, 1988

[54] MULTIPLE CONNECTOR

[75] Inventor: Oswald Reuss, Unterelsbach, Fed. Rep. of Germany

[73] Assignee: Preh Elektrofeinmechanische Werke Jakob Preh Nachf. GmbH & Co., Bad Neustadt, Fed. Rep. of Germany

[21] Appl. No.: 807,499

[22] Filed: Dec. 11, 1985

[30] Foreign Application Priority Data

Dec. 21, 1984 [DE] Fed. Rep. of Germany ..... 3446954

[51] Int. Cl.[4] ..... H01R 13/42

[52] U.S. Cl. ..... 439/701; 439/731; 439/752

[58] Field of Search ..... 339/196 R, 196 M, 143 R, 339/136 M, 136 R, 176 M, 210 R, 210 M, 206 R, 206 P, 208, 99 R, 217 R; 439/460, 465, 467, 468, 473, 686–687, 695–696, 701, 731, 752

[56] References Cited

U.S. PATENT DOCUMENTS

| | | | |
|---|---|---|---|
| 2,032,470 | 3/1936 | Chirelstein | 339/217 R |
| 3,518,617 | 6/1970 | Bosworth | 439/465 |
| 3,680,035 | 7/1972 | Teagno et al. | 339/210 M |
| 4,139,727 | 2/1979 | Kuballa | 339/210 M |
| 4,408,823 | 10/1983 | Hubev | 339/208 |

FOREIGN PATENT DOCUMENTS

| | | |
|---|---|---|
| 2706464 | 12/1983 | Fed. Rep. of Germany . |
| 3241120 | 1/1984 | Fed. Rep. of Germany . |

*Primary Examiner*—John McQuade

*Attorney, Agent, or Firm*—Woodcock, Washburn, Kurtz, Mackiewicz & Norris

[57] ABSTRACT

A multipoint connector provides a contact support element for holding contact blades staggeredly arranged in two rows of chambers. To simplify the structure of the multipoint connector, the contact support element comprises a first and a second support element being integrally formed with respective housing half-shells which are pivotally connected so that they can be opened, or closed upon each other. The separating surface between the two support elements is arranged such that all chambers are located in the first support element. The contact blades may be inserted into the chambers from the separating surface when the support elements are open. The second support element closes the chambers when it is closed upon the first support element.

15 Claims, 2 Drawing Sheets

MULTIPLE CONNECTOR

BACKGROUND OF THE INVENTION

This invention relates to a multipoint connector comprising a housing with first and second plastic half-shells between which a contact element support made of an insulating material is held, the support comprising chambers into which contact elements connected to the conductors of a multi-core cable are inserted, with the chambers arranged staggeredly in two rows.

Multipoint connectors of this general form are known in the prior art. The contact element support in such known multipoint connectors consists of an integral unit being an additional element housed by the two half-shells, which half-shells may be connected by a hinge.

In such known multipoint connectors the contact elements formed by contact blades must be plugged in their longitudinal direction into the chambers of the contact element support, which involves a complicated and difficult procedure. There has thus been a need for a simplified and improved construction of such connectors which enables easy and reliable placement of the contact elements.

BRIEF SUMMARY OF THE INVENTION

A primary object of this invention is to simplify the structure of a multipoint connector of the kind having a plural chamber support into which contact elements are placed and held.

According to the invention, the above-mentioned task is solved in such a way that the contact element support comprises first and second support elements, with the first support element being integrally formed with the first housing half-shell and the second support element being integrally formed with the second housing half-shell, the separating surface between the two support elements being arranged such that all chambers of the two rows are located in the first support element. When the two half-shell housings are opened, a plug-in opening is provided at each chamber of both rows for inserting the contact elements directly into the open chambers of the first support element, wherein all plug-in openings may be closed by the second support element which serves as a lid.

In the preferred embodiment, as illustrated by the following detailed description, all contact elements can be inserted into the first support element from the separating surface. Preferably, they should already be connected with the conductors. After the second support element and the second housing half-shell have been put on, the chambers are closed. The housing and the support element consist of two units only, such units being pivoted to each other according to an embodiment of the invention.

DESCRIPTION OF THE PREFERRED EMBODIMENT

Figure 1:
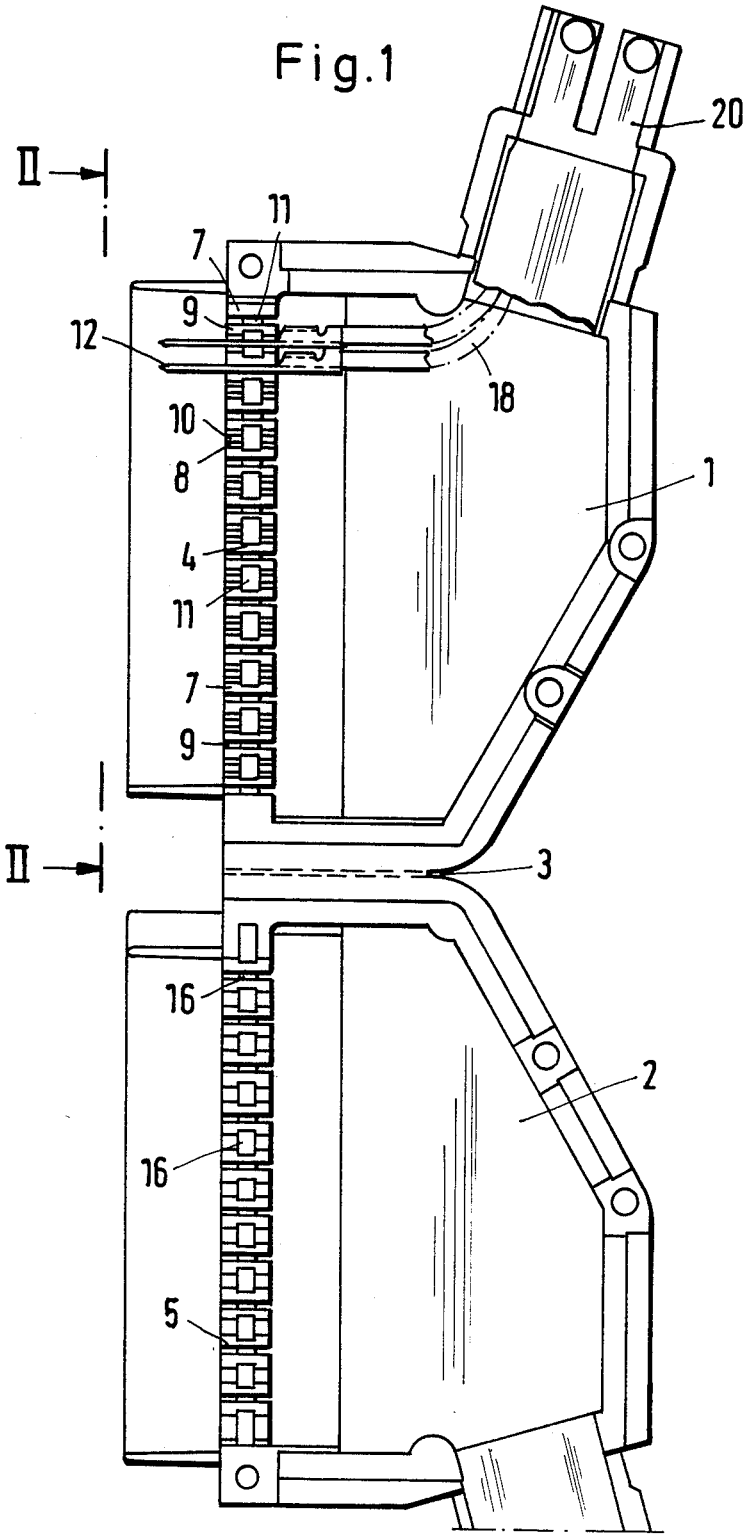
FIG. 1 is a top view of the multipoint connector with the housing half-shells being open.
Figure 2:
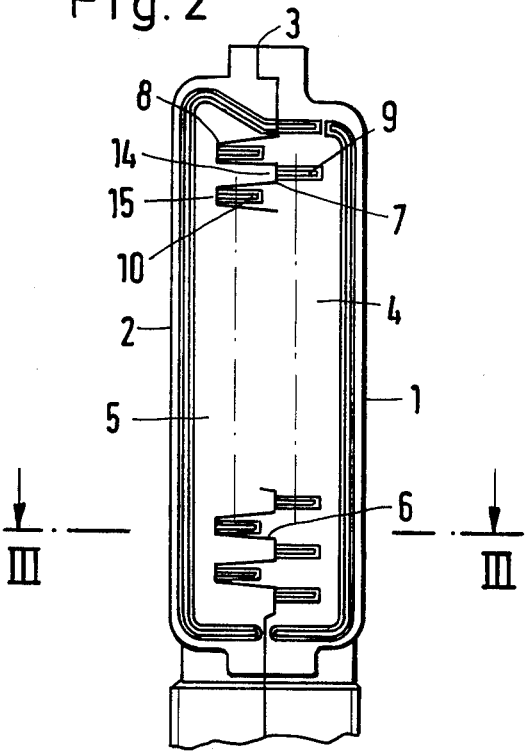
FIG. 2 is a view of the multipoint connector along line II—II of FIG. 1, with the housing half-shells being shut.
Figure 3:
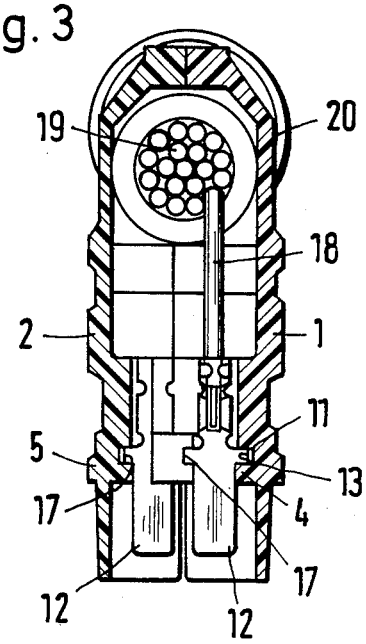
FIG. 3 is a section along line III—III of FIG. 2.

The multipoint connector comprises a first housing half-shell 1 and a second housing half-shell 2. Both housing half-shells 1 and 2 are connected by means of a hinge 3. A first support element 4 is integrally formed with the first housing half-shell 1. A second support element 5 is integrally formed with the second housing half-shell 2. When half-shells 1 and 2 are brought together, the separating surface 6 (FIG. 2) between the two support elements 4 and 5 zigzags with first depressions 7 and first elevations 8 at the surface of first support element 4.

The depressions 7 in the surface of first support element 4 are provided with a first row of slot-shaped chambers 9. At the elevations 8 a second row of slot-shaped chambers 10 is provided for. At the bottom of the chambers 9, 10 recesses 11 are formed. Contact blades 12 are inserted into chambers 9, 10, which blades have side lugs 13 which mate into the recesses 11.

The separating surface 6 is provided with second elevations 14 and depressions 15 at the surface of the second support element 5, said second elevations and depressions being mirror-inverted to the depressions 7 and elevations 8 of support element 4. Recesses 16 are provided at the elevations 14 and depressions 15, said recesses 16 receiving further side lugs 17 of the contact blades 12.

The contact blades 12 are connected with conductors 18 of a multi-core cable 19, said cable extending out of the multipoint connector through a sleeve 20.

For assembling the multipoint connector the half-shells 1, 2 are laid open and the contact blades 12 connected with the conductors 18 are put into the chambers 9, 10 from the side. The contact blades 12 are held in the longitudinal direction of the chambers since their side lugs 13 mate into the recesses 11.

The housing half-shells 1 and 2 are subsequently shut, with the support elements 4 and 5 being closely adjacent to each other. The further side lugs 17 extend into the recesses 16 of the second support element 5. It is a particular advantage that all contact blades 12 may be placed from the side into the same support element 4, said blades being held in chambers 9 until the second support element 5 is folded onto the first support element 4, with the chamber being closed lid-like, thus securing the position of the contact blade. It is also within the scope of the invention to provide not only the recesses 16 in the second support element 5, but also to form a greater part of the chamber walls in the second support element.

I claim:

1. A multipoint connector comprising a housing with a first and a second half-shell of plastics material, a contact support element made of an insulating material, the support comprising chambers into which contact elements being connected with the conductors of a multi-core cable are inserted, said chambers being arranged staggeredly two rows, characterized in that the contact element support comprises first and second support elements with said first support element being integrally formed with said first housing half-shell and said second support element being integrally formed with said second housing half-shell, that said two support elements when closed define a separating surface between them, all of said chambers of both said two rows located in said first support element, each chamber of both rows having a plug-in opening for receiving a contact element, each plug-in opening remaining open when said half-shells are open, wherein all plug-in openings may be closed by the second support element serving as lid.

2. The multipoint connector according to claim 1, further characterized by a hinge which pivotally connects the two housing half-shells to each other.

3. The multipoint connector according to claim 1, characterized in that said separating surface zigzags with depressions and elevations in an opposing surface of said first support element, with the chambers of every other row being formed in the depression and the chambers of the alternate rows being formed in the elevations.

4. The multipoint connector according to claim 2, characterized in that said separating surface zigzags with depressions and elevations in an opposing surface of said first support element, with the chambers of every other row being formed in the depressions and the chambers of the alternate rows being formed in the elevations.

5. The multipoint connector according to claim 3, characterized in that the second support element is provided with elevations and depressions being mirror-inverted to the depressions and elevations of the first support element.

6. The multipoint connector according to claim 1, wherein said contact elements have first side lugs, and characterized in that the chambers are provided with first recesses for the accommodation of said first side lugs.

7. The multipoint connector according to claim 3, wherein said contact elements have first side lugs, and characterized in that the chambers are provided with first recesses for the accommodation of said first side lugs.

8. The multipoint connector according to claim 4, wherein said contact elements have first side lugs, and characterized in that the chambers are provided with first recesses for the accommodation of said first side lugs.

9. The multipoint connector according to claim 5, wherein said contact elements have first side lugs, and characterized in that the chambers are provided with first recesses for the accommodation of said first side lugs.

10. The multipoint connector according to claim 6, wherein said contact elements have second side lugs, and characterized in that at the second support element second recesses are provided for the accommodation of said second side lugs of the contact elements.

11. The multipoint connector according to claim 7, wherein said contact elements have second side lugs, and characterized in that at the second support element second recesses are provided for the accommodation of said second side lugs of the contact elements.

12. The multipoint connector according to claim 8, wherein said contact elements have second side lugs, and characterized in that at the second support element second recesses are provided for the accommodation of said second side lugs of the contact elements.

13. The multipoint connector according to claim 9, wherein said contact elements have second side lugs, and characterized in that at the second support element second recesses are provided for the accommodation of said second side lugs of the contact elements.

14. Multi-point connector apparatus comprising means for receiving a multi-conductor cable, each conductor terminating in a contact blade to be held in a predetermined position by said connector, first and second plastic half-shells containing integrally therewith respective first and second contact support elements, hinge means for pivotally connecting said half-shells so that they may be positioned to open or closed positions with respect to each other, said connector being further characterized by said first support element having a first surface with first alternating depressions and elevations, said first support element having a chamber positioned at each said first depression and elevation for receiving and holding one of said contact blades, and said second support element having a second surface with second elevations and depressions mirror-inverted with and staggered relative to said first depressions and elevations in a zig-zag pattern such that said second surface mates with said first surface when said half-shells are closed, whereby when said half-shells are open, said blades may be placed in said chambers, and when said second half-shell is closed upon said first half-shell, said second surface mates with said first surface to hold said contact blades securely in said chambers.

15. The connector as described in claim 14, wherein each said blade has first and second lugs on opposite sides thereof, and wherein each chamber has a first recess for receiving a said first lug and each depression and elevation of said second surface has formed therein a second recess for receiving a second lug.

* * * * *